US008905333B1

(12) United States Patent
Sykes et al.

(10) Patent No.: US 8,905,333 B1
(45) Date of Patent: Dec. 9, 2014

(54) DIESEL INJECTOR AND METHOD UTILIZING FOCUSED SUPERCAVITATION TO REDUCE SPRAY PENETRATION LENGTH

(75) Inventors: David M. Sykes, Melbourne, FL (US); Joseph Homitz, Melbourne, FL (US); Gregory S. Cole, Melbourne, FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 0 days.

(21) Appl. No.: 13/114,080

(22) Filed: May 24, 2011

(51) Int. Cl.
*F02M 61/00* (2006.01)

(52) U.S. Cl.
USPC ..... 239/533.12; 239/585.5; 239/5

(58) Field of Classification Search
CPC F02M 51/0653; F02M 59/366; F02M 59/466
USPC ..... 239/88–95, 533.2, 533.11, 533.12, 584, 239/585.1, 585.3, 585.4, 585.5, 5
See application file for complete search history.

(56) References Cited

U.S. PATENT DOCUMENTS

| | | | | |
|---|---|---|---|---|
| 5,353,992 | A * | 10/1994 | Regueiro | 239/533.12 |
| 7,070,126 | B2 * | 7/2006 | Shinogle | 239/584 |
| 7,533,655 | B2 | 5/2009 | Allen | |
| 7,578,450 | B2 | 8/2009 | Stockner et al. | |
| 7,740,187 | B2 | 6/2010 | Ricco et al. | |
| 7,793,862 | B2 | 9/2010 | Ricco et al. | |
| 7,798,130 | B2 | 9/2010 | Allen | |
| 7,841,544 | B2 | 11/2010 | Haddock et al. | |
| 7,850,099 | B2 | 12/2010 | Jones | |
| 7,878,052 | B2 * | 2/2011 | Danby et al. | 73/114.49 |
| 8,201,543 | B2 * | 6/2012 | Morris et al. | 123/494 |
| 8,387,599 | B2 * | 3/2013 | McAlister | 123/675 |

OTHER PUBLICATIONS

Payri, F., Arregle, J., Lopez, J., and Hermens, S. "Effect of Cavitation the Nozzle Outlet Flow, Spray and Flame Formation in a Diesel Engine" SAE Paper No. 2006-01-1391, Society of Automotive Engineers, Warrendale, PA, 2006.

Schnieder, B., Kosar, A., and Peles, Y. "Hydrodynamic Cavitation and Boiling in Refrigerant (R-123) Flow Inside Microchannels" International Journal of Heat and Mass Transfer, vol. 50, 2007.

Gavaises, M., Papoulias, D., Andriotis, A., Giannadakis, E., and Theodorakakos, A. "Link Between Cavitation Development and Erosion Damage in Diesel Injector Nozzles" SAE Paper No. 2007-01-0246, Society of Automotive Engineers, Warrendale, PA, 2007.

Giannadakis, E., Papoulias, D., Gavaises, M., Arcoumanis, C., Soteriou, C., and Tang, W. "Evaluation of the Predictive Capability of Diesel Nozzle Cavitation Models" SAE Paper No. 2007-01-0245, Society of Automotive Engineers, Warrendale, PA, 2007.

Rotondi, R., Bella, G., Grimaldi, C., and Postrioti, L., "Atomization of high-Pressure Diesel Spray: Experimental Validation of a New Breakup Model" SAE Paper No. 2001-01-1070, Society of Automotive Engineers, Warrendale, PA, 2001.

(Continued)

*Primary Examiner* — Davis Hwu

(57) ABSTRACT

A method and apparatus are disclosed for inducing a supercavitating flow inside a fuel injection nozzle orifice to reduce the penetration length of the fuel spray, maintain high levels of fuel atomization, and improve uniformity of the fuel spray exiting the nozzle such that high-pressure injectors can be used on small engines. This reduction in penetration length is accomplished without any reduction in upstream fuel pressure.

10 Claims, 4 Drawing Sheets

(56) References Cited

OTHER PUBLICATIONS

Desantes, J., Payri, R., Salvador, F., and Gimeno, J. "Measurements of Spray Momentum for the Study of Cavitation in Diesel Injection Nozzles" SAE Paper No. 2003-01-0703, Society of Automotive Engineers, Warrendale, PA, 2003.

J. C. Dent, "A Basis for the Comparison of Various Experimental Methods for Studying Spray Penetration" SAE Date Published: Feb. 1, 1971 Paper No. 710571.

Liu, Yi, Reitz, Rolf D., "Optimizing HSDI Diesel Combustion and Emissions Using Multiple Injection Strategies" SAE Paper No. 2005-01-0212 Engine Research Center, University of Wisconsin—Madison.

Russell, M. F., Greeves, G., Guerrassi, N., "More Torque, Less Emissions and Less Noise" SAE Paper No. 2000-01-0942 Delphi Diesel Systems.

Tullis, S., Greeves, G., Improving $NO_x$ Versus BSFC With EUI 200 Using EGR and Pilot Injection for Heavy-Duty Diesel Engines, SAE Paper Series 960843, Lucas Diesel Systems.

* cited by examiner

DIESEL INJECTOR AND METHOD UTILIZING FOCUSED SUPERCAVITATION TO REDUCE SPRAY PENETRATION LENGTH

BACKGROUND AND SUMMARY OF THE INVENTION

The present invention relates to a method and apparatus for reducing spray penetration length for diesel engines, and more particularly to a method and apparatus that uses supercavitation so as to allow highly atomized sprays to be employed for small engine, high-pressure diesel injection systems.

Over the past two decades, advances in high-pressure, electronically-controlled diesel fuel injection technology have had a significant impact on diesel engine efficiency, exhaust emissions, and engine noise. These advances have been primarily limited to larger engines in the output power range of 40 hp or greater. This has been due to inherent technical limitations with scaling to smaller engines. Along with the development of electronically controlled fuel injection, researchers and manufacturers have made use of increasing fuel pressures as a method to produce highly atomized sprays and deliver fuel to the cylinder quickly. Highly atomized spray patterns provide for improved engine efficiency and the ability to deliver fuel to the cylinder quickly which is required by the high rotational speeds of high-power-density engines. The conventional approach has been to enhance these features by using high fuel pressures (up to 2,500 bar) but this has been found to result in long fuel jet penetration lengths, something which is not desirable for a small engine injection system. Long fuel jet penetration lengths in small engine piston bowls/cylinders lead to wetting the piston bowl wall and cylinder wall which can reduce fuel vaporization rates, increase emissions, increase ignition delay, and wash lubricants from the cylinder wall decreasing durability/performance. The prior art recognizes that to provide a high-pressure injector for small engines much less than 40 hp range requires that the fuel spray penetration length be significantly decreased but up until now has not found any practical way of doing so.

It is generally recognized that the presence of bubbly cavitation in diesel injectors improves the quality of atomization. For example, U.S. Pat. Nos. 7,798,130 and 7,533,655 discuss how a sonic nozzle aids in dispersing the fuel into the air with cavitation bubbles to produce a fine atomization. But it is also well known that the unsteady and erratic nature of typical cavitation can lead to cycle-to-cycle variations in spray penetration and nozzle balance, and therefore cavitation is something that is normally avoided to the extent possible in injector nozzles. For example, U.S. Pat. No. 7,850,099 discloses a method to reduce the risk of cavitation. Likewise, U.S. Pat. No. 7,841,544 discloses an injector configuration that provides a minimum of flow cavitation, and U.S. Pat. No. 7,578,450 B2 discusses how his design has the benefit of decreasing cavitation effects within the tip. U.S. Pat. Nos. 7,740,187 and 7,793,862 discuss the promotion of cavitation within the fuel injector control valve portion, but not the injection tip.

Although supercavitation has never been suggested for a fuel injector nozzle, supercavitation in mico-channels is well documented in the literature. For example, Schnieder, B., Kosar, A., and Peles, Y. "*Hydrodynamic Cavitation and Boiling in Refrigerant* (*R*-123) *Flow Inside Microchannels*" (*International Journal of Heat and Mass Transfer*, Vol. 50, 2007) has demonstrated the following pattern for supercavitating flows in microchannels:

- A liquid jet is created immediately following the nozzle orifice and extends 20 to 25 orifice diameters downstream of the orifice;
- A transition region follows after the liquid jet region and this transition region's length is determined by the cavitation number of the flow;
- A wavy annular region that only occurs with low cavitation numbers and is characterized by a vapor core surrounded by a liquid annulus; and
- A bubbly region in which, as the static pressure continues to rise, the vapor core collapses leaving only a few remaining bubbles.

We have discovered, however, that with the proper type of cavitation, namely supercavitation, the unsteady and erratic performance associated with typical cavitation can be avoided, the improved atomization (known to exist with all types of cavitation) can be provided and the liquid spray penetration length shortened. The reduction in spray penetration length allows smaller diesel engines to be built with effective high-pressure, low-emissions atomizing injectors.

More specifically, we have discovered an injector nozzle profile where the fuel exits the nozzle in the above-mentioned wavy annular region (which only occurs with low cavitation numbers), but tailoring the flow morphology in which the bubbly flow regime exists at the exit and thereby to provide the desired reduction in fuel penetration length.

One of the main parameters that control this flow pattern morphology is the cavitation number which is defined as:

$$\sigma = \frac{P_e - P_V}{\frac{1}{2}\rho\mu^2} \tag{1}$$

where $P_e$ is the exit pressure, $P_v$ is the vapor pressure of the fluid, ρ is the liquid-phase density, and u is the liquid velocity at the inlet restrictor. FIG. 1 shows the effect of the cavitation number on the types of flow regimes that are present for water. An additional experiment was conducted with R-123 and the trends are similar, however the actual cavitation index at the transitions did change, however, demonstrating that the results obtained are a function of the fluid used.

Prior research into improved fuel injectors has studied the effects of cavitation on the discharge coefficient, the area blockage of the injector hole, the momentum and mass fluxes emanating from the injection holes, the quality of the spray, and erosion problems inside of the injector. However, these prior studies appear to have been conducted with either bubbly cavitation or string cavitation, which is resultant of flow vortices that are created as the liquid passes through the injection channel [see, e.g., Schnieder, B., Kosar, A., and Peles, Y. "Hydrodynamic Cavitation and Boiling in Refrigerant (R-123) Flow Inside Microchannels" International Journal of Heat and Mass Transfer, Vol. 50, 2007; Payri, F., Arregle, J., Lopez, J., and Hermens, S. "Effect of Cavitation on the Nozzle Outlet Flow, Spray and Flame Formation in a Diesel Engine" SAE Paper No. 2006-01-1391, Society of Automotive Engineers, Warrendale, Pa., 2006; Gavaises, M., Papoulias, D., Andriotis, A., Giannadakis, E., and Theodorakakos, A. "Link Between Cavitation Development and Erosion Damage in Diesel Injector Nozzles" SAE Paper No. 2007-01-0246, Society of Automotive Engineers, Warrendale, Pa., 2007; and Giannadakis, E., Papoulias, D., Gavaises, M., Arcoumanis, C., Soteriou, C., and Tang, W. "Evaluation of the Predictive Capability of Diesel Nozzle Cavitation Models" SAE Paper No. 2007-01-0245, Society of Automotive Engineers, Warrendale, Pa., 2007.

Unlike these known configurations, our approach uses a supercavitating inverse annular flow inside the injector for improved atomization, reduced penetration lengths, and improved fuel distribution.

The atomization process for high pressure injection systems ($P_{inj}$>1200 bar) is typically divided into two different processes, primary atomization and secondary atomization. Primary atomization is a result of surface waves generated by turbulence or cavitation upstream in the nozzle which are amplified by aerodynamic forces until fracture of the liquid jet emanating from the injection hole as discussed in Rotondi, R., Bella, G., Grimaldi, C., and Postrioti, L. "Atmoization of high-Pressure Diesel Spray: Experimental Validation of a New Breakup Model" SAE Paper No. 2001-01-1070, Society of Automotive Engineers, Warrendale, Pa., 2001. The size of the droplet at fracture is dependent on the initial diameter of the liquid jet, the surface tension at the fuel/air interface, relative velocities, and the viscosity of the air [Id.]. In a supercavitating spray that utilizes a wavy annular flow morphology there are two surfaces that the aerodynamic forces act on; the outside and inside of the annular jet. A non-cavitating spray has only one surface that the aerodynamic forces act on; the outside of the round jet. Therefore, the atomization for a round liquid jet and a wavy annular flow are drastically different.

Secondary atomization, as its name suggests, is the process of initial droplets further breaking down. This process is unaffected by the origin of the droplets, so the utilization of supercavitating flow has minimal impact.

Other phenomenon that impact the design of the proposed supercavitating nozzle is that once supercavitation occurs, the mass flux through a given orifice is choked. However, with an increase in upstream pressure, the momentum flux will continue to increase [see, e.g., Desantes, J., Payri, R., Salvador, F., and Gimeno, J. "Measurements of Spray Momentum for the Study of Cavitation in Diesel Injection Nozzles" SAE Paper No. 2003-01-0703, Society of Automotive Engineers, Warrendale, Pa., 2003]. This is directly related to the penetration length along with droplet size.

Therefore, an object of the present invention is to provide an injection nozzle profile induces supercavitating flows with the wavy annular flow path at the minimum upstream pressure to gain the benefits of the flow morphology and quick fuel delivery but avoid excessive momentum flux that would induce a longer penetration length.

BRIEF DESCRIPTION OF THE DRAWINGS

This and further objects, features and advantages of the present invention will be seen by the following detailed description of a currently preferred, non-limiting embodiment of the present invention shown in the accompanying drawings wherein.

DETAILED DESCRIPTION OF A CURRENTLY PREFERRED EMBODIMENT

Figure 1:
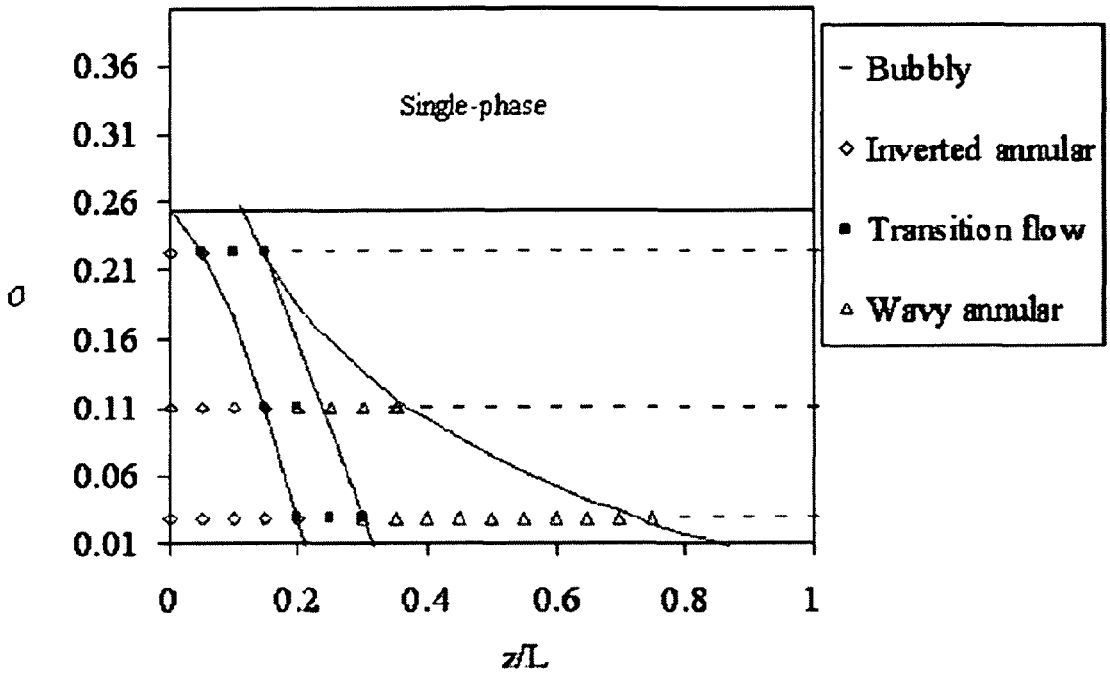
Figure 1 Prior Art
FIG. 1 is a graph showing the cavitation regime as a function of cavitation number and position for water.
Figure 2:
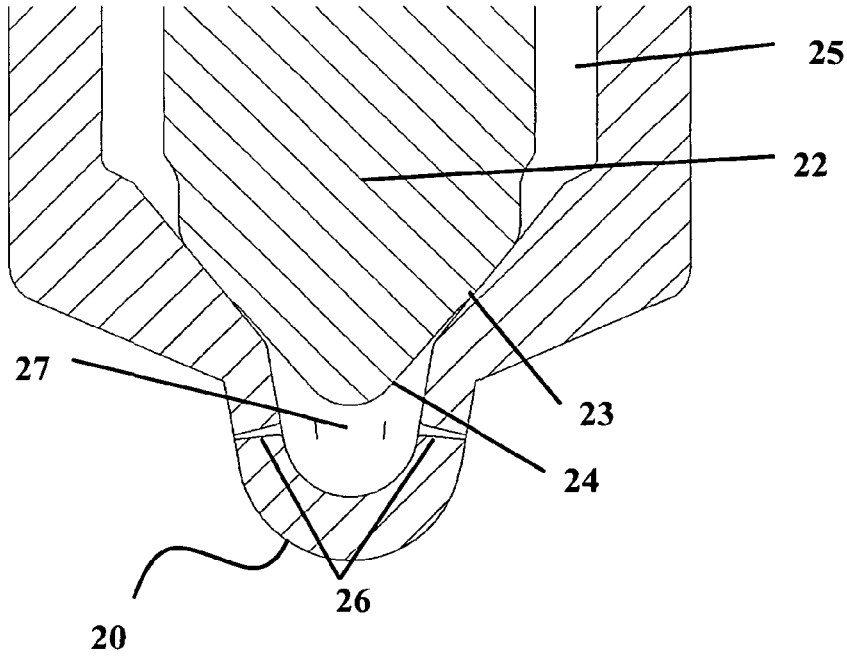
Figure 2 Prior Art
FIG. 2 is a schematic cross-sectional view of a conventional injector tip.

A supercavitating injector according to the present invention has the advantage that it can be incorporated onto existing piezo-electric or solenoid type, modern diesel fuel injectors. The conventional injector has a plurality of rounded and tapered nozzles that emanate from a sac volume as shown in FIG. 2. High pressure fuel is fed from a pump to fill a large portion of the injector. A moveable needle segregates this internal portion of the injector to a sac volume. The sac volume typically has either one or a plurality of nozzles that are in fluidic communication with the sac volume and are responsible for delivering fuel to the combustion cylinder of the engine.

More specifically, FIG. 2 shows a conventional injector tip (20) that is typically used currently in the diesel engine field in which a moveable needle (22) creates a mechanical seal (23) with the injector tip (24) while not in operation. During this time, full fluid pressure exists above this seal, and a sac volume (27) is created below the seal, at a substantially lower pressure. The sac volume in an injector typically controls some emissions characteristics and spray symmetry. During fuel injection operation, the needle is lifted and high pressure fuel (25) from a line or common rail flows past the needle into the sac volume (27) and out of a plurality injection nozzles (26). In typical applications there are between 4 and 8 injection nozzles per injector rail or line. The high pressure injection translates into high fuel velocities entering each nozzle section. As the fluid flows from the sac volume to the nozzle, it encounters a substantial turning angle, inducing cavitation. Conventional injectors take steps to avoid this cavitation, since it is known to cause cycle-to-cycle and nozzle-to-nozzle variations in the fuel injection characteristics.

Figure 3:
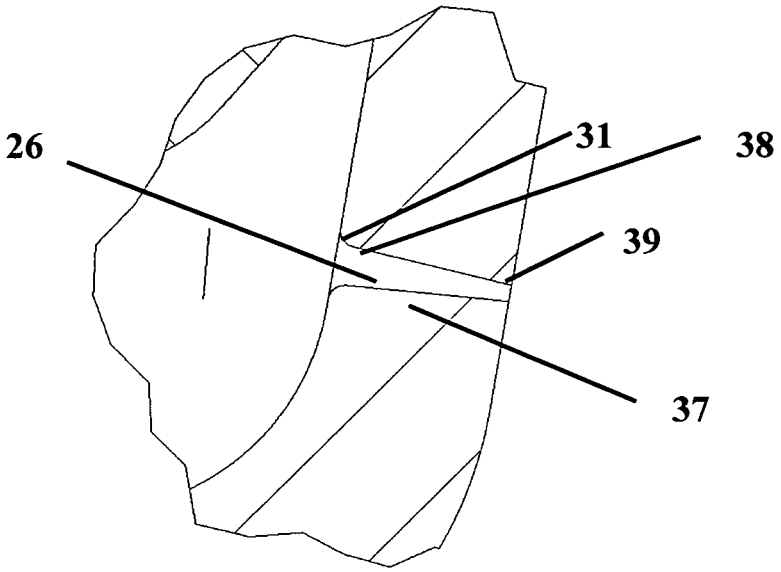
Figure 3 Prior Art
FIG. 3 is an enlarged detail view of the nozzle in the conventional injector tip shown in FIG. 2.

FIG. 3 is a more detailed view of the nozzle section (26) of a conventional injector tip (20). To avoid the cavitation that occurs from flow separation around a sharp corner, a smooth radius (31) is incorporated with a tapered design (37). Both of these geometric properties discourage the initiation of cavitation. The effect is a cavitation-free injection that is known in the art to reduce hydrocarbon emissions and provide a uniform spray across the different nozzles. It is important to note that the diameter at the inlet of the nozzle (38) is large compared to the nozzle final diameter (39) in this conventional nozzle to achieve this cavitation-free effect.

Figure 4:
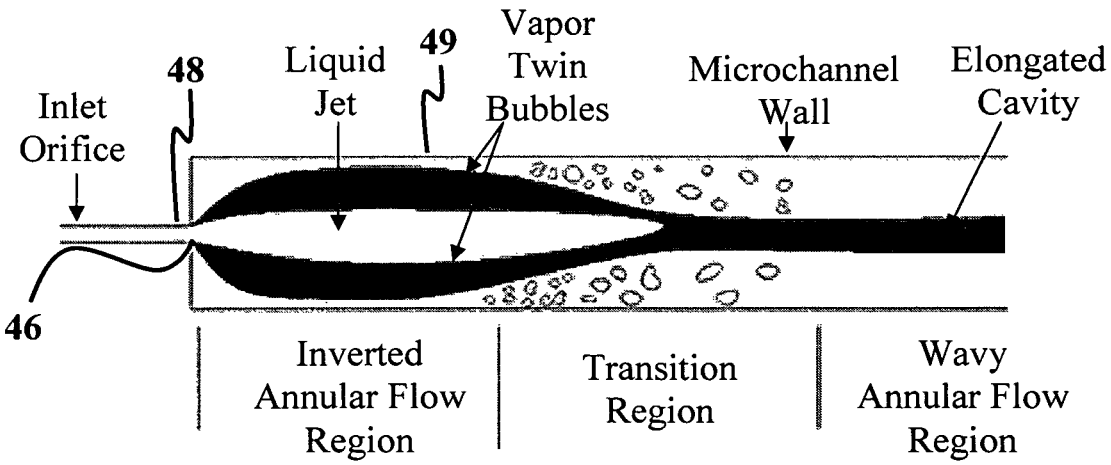
Figure 4 Prior Art
FIG. 4 shows the conventional flow morphologies in a stepped nozzle.

Our discovery has been that the alteration of these conventional injector tips by employing nozzles that create a supercavitating flow dramatically reduces penetration length. The known sudden expansion nozzle is the simplest, though not the only, method of inducing supercavitating flow. In particular, we have discovered that there is an unanticipated benefit that results from taking advantage of the different flow morphologies that are associated with supercavitating flow, namely shorter penetration lengths, improved atomization, and therefore reduced combustion time. As stated previously, while there are different methods well known in the art to induce supercavitating flow, our currently preferred embodiment is a conventional single-stepped nozzle 46 as shown in FIG. 4, due to its ease of manufacturing and simplicity. The first section (or inlet section) of the stepped nozzle acts as an inlet orifice (48) to drastically reduce the static pressure of the flowing fuel, and the second section of the stepped nozzle (49) enables different flow morphologies such as inverted annular flow, transition, and then wavy annular flow to develop down the constant cross-sectional flow path. FIG. 4 shows the supercavitating flow morphologies that develop in the second section of the stepped nozzle. This known geometry as shown in FIG. 4 is incorporated into the nozzle portion of the injector to create a supercavitating injector tip as shown in FIG. 5.

Figure 5:
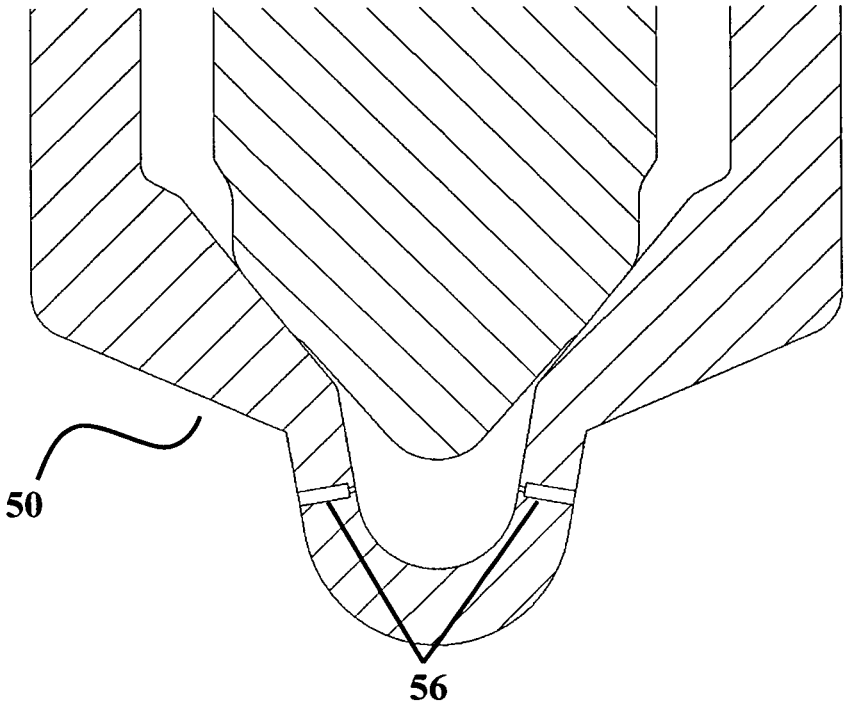
FIG. 5 is a sectional view of a supercavitating injector tip in accordance with the present invention.

FIG. 5 is a sectional view of a supercavitating injector tip. The overall geometry of the injector is substantially similar to that of a conventional injector shown in FIGS. 2 and 3 as it is only the profile of the ejector nozzle (56) in the injector tip (50) that needs to be changed in order to achieve a dramatically improved effect. This is, of course, a manufacturing and practical benefit since our improvement to the nozzle profile is straightforward to implement and as discussed later is actually less expensive to manufacture when compared to current tapered cross-section with rounded-entrance nozzle profile.

Figure 6:
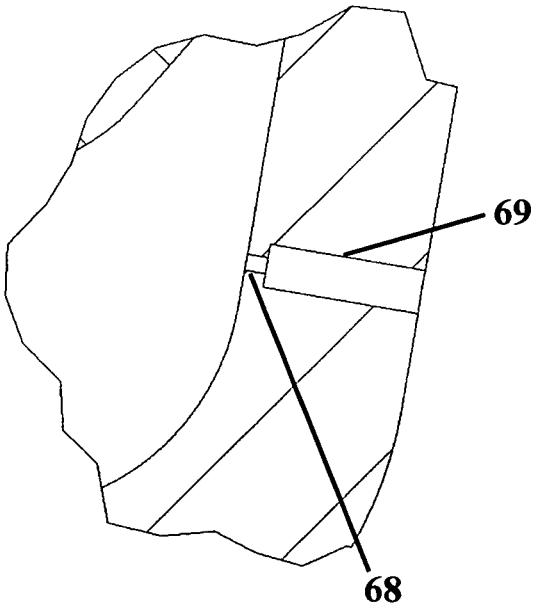
FIG. 6 is an enlarged sectional view of the tip region in a supercavitating injector nozzle according to the present invention.

The disclosed supercavitating nozzle (56) geometry within the substantially conventional injector tip (50) is substantially different than the conventional nozzle profile. To create a supercavitating flow special care must be taken with the design of the stepped nozzles (56). To further explain, FIG. 6 is a detailed view of a supercavitating stepped nozzle tip region. We have determined that an area ratio, defined as the area of the second section of the stepped nozzle (69) divided by the first section of the stepped nozzle (68), of at least 12 is needed to produce a supercavitating flow. With current processes, the minimum diameter that is typically used in practice for any minimum fuel passage opening is approximately 80 μm. Smaller diameters are typically not used, due to the propensity of clogging and coking the fuel. Therefore, the lower limit on the diameter for the first section is 80 μm and the lower limit on the corresponding second section of the stepped nozzle is 277 μm (12 times the area or 4.46 times the diameter).

The flow length of the second section (69) also must be long enough to allow the formation of the supercavitating flow morphologies, that is the passage must be long enough to allow the initial inverted annular flow to transition to wavy annular flow within the second section of the stepped nozzle. For the 80 μm first section and 277 μm second section operating on diesel fuel and with the injection rail pressure used, we have found that at least a 3 mm length is needed to transition the fuel flow to the wavy annular flow pattern within the second section of the stepped supercavitating nozzle. While too long of a second section could result in the second transition from wavy annular flow to bubbly flow, this length is far beyond the practical length of a possible passage in a typical injector tip. Of course, the cavitating behavior is dependent on fluid properties and upstream geometry. Thus, the specific geometry (length) to enable supercavitation with the fuel exiting in a wavy annular flow region, must be determined for each fuel and engine application; however this procedure is well known to those skilled in the art.

As above noted, another advantage of the disclosed supercavitating stepped nozzle is that it can be manufactured in a simpler manner than the conventional nozzles. A conventional fuel injector nozzle is typically manufactured with four processes. The first is an Electrical Discharge Machining (EDM) process that establishes a base diameter and taper. Next, three separate hydro-erosive grinding processes establish the inlet radius, smooth the surfaces of the nozzle, and finish the target diameter and taper of the nozzle, respectively.

Alternatively, the stepped nozzle that is required for the supercavitation flow morphologies can be manufactured in a significantly different fashion. The small first section can be manufactured via electrical discharge machining, while the second section (which is 3.46 times the diameter) can be machined via semi-conventional mechanical machining techniques. No smoothing inlet radius and no passage tapers need to be introduced.

Figure 7:
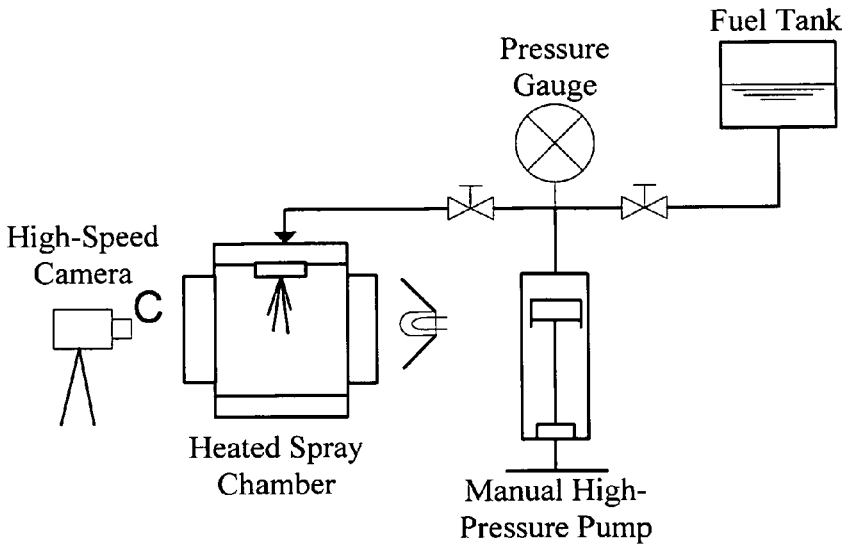
FIG. 7 shows the schematic of the injection test stand used demonstrate the efficacy of the present invention.

To demonstrate the benefit of the supercavitating injector, we performed a comparative study, using conventional nozzle geometry as the control to examine the effects of cavitation on diesel fuel injection penetration length and atomization. We used a customized spray chamber assembly, as shown schematically in FIG. 7 that allows a single spray to be injected into a relevant atmosphere. The penetration length of a supercavitating spray and the baseline spray were measured with the use of a high-speed camera. In this experimental system, the conventional nozzle was tested and then it was fitted with a supercavitating outer housing so that an accurate comparison of the effect of the supercavitating geometry with a conventional nozzle geometry can be performed.

To verify the benefits as well as the effect of the temperature and pressure on the new nozzle geometry, three different temperatures (27, 47, and 57° C.) and three different chamber pressures (791, 854, and 886 kPa) were experimentally evaluated. The results were fitted to a flow model, so that extrapolation to other conditions could also be performed. An electronic control simultaneously activated the injector and a high speed camera. The camera was set with an exposure time of 13 frame rate of 5670 Hz, and an f-stop of 2.4. The high speed images allowed the penetration length of the fuel spray into the chamber to be determined optically. For all of the tests, the following parameters were held constant:

Fuel injection pressure (689 MPa)
Injector orifice diameter (80 μm)
Injection Duration (5 ms)
Optical magnification (0.117 mm/pixel)

After each injection, the spray penetration was measured from the high speed photography. Each frame of the photography was taken in 0.176 ms intervals.

Once the spray penetrations were measured, the raw date was fitted to an empirical correlation proposed by Dent, J. C., "Basis for the Comparison of Various Experimental Methods for Studying Spray Penetration," SAE paper 710571, 1971, and shown in the following equation:

$$S = 3.07\left(\frac{\Delta P}{\rho_g}\right)^{1/4}\sqrt{td_n}\left(\frac{294}{T_g}\right)^{1/4} \tag{2}$$

where S is the penetration length, ΔP is the pressure drop across the nozzle, $\rho_g$ is the density of the ambient gas, t is time, $d_n$ is the orifice diameter, and $T_g$ is the temperature of the ambient gas. During a single injection, all of the parameters in the above equation remain constant. Thus, the equation can be functionally written as:

$$S=C=\sqrt{t}\ C=C(\rho_g,\Delta P,T_g,d_n) \tag{3}$$

Thus, the ratio of C-values of different injections is equal to the ratio of penetration lengths of the different injections. For each of the test cases that were run, the functional form of the equation was fitted to the data to find the C-value for each different type of injection. The mean average error in these curve fits was only 1.69%, and the maximum mean average error for any case tested was only 2.77%, indicated a very good fit of the experimental data to the empirical relation used. Once the C-values were determined the penetration lengths of the two nozzle configurations could be compared over a wider range.

Table 1 below shows the C-values for both non-cavitating and cavitating sprays for different temperatures at a constant density. As the temperature increases for the non-cavitating spray the C-values decrease from 56.5 to 52.6 $mm(ms)^{-1/2}$, confirming the behavior trends predicted by Equation (2). The same set of experiments were performed for the cavitating injection. These values dropped from 55.3 to 47.8 $mm(ms)^{-1/2}$ over the moderate 30° C. temperature span. The further improved reduction in the cavitation injection C-values with increasing temperature is due to the higher rates of cavitation at higher temperatures, caused by the increased vapor pressure.

TABLE 1

C-values for cavitating and non-cavitating injections for different temperatures at constant density

| | C-values $mm(ms)^{-1/2}$ | | | | | |
|---|---|---|---|---|---|---|
| | Cavitating Injection | | | Non-Cavitating Injection | | |
| Temperature | test1 | test2 | average | test1 | test2 | average |
| 27° C. | 56.2 | 54.3 | 55.3 | 57.0 | 56.0 | 56.5 |
| 47° C. | 50.4 | 48.7 | 49.6 | 55.0 | 54.9 | 55.0 |
| 57° C. | 47.3 | 48.2 | 47.8 | 53.1 | 52.0 | 52.6 |

Figure 8:
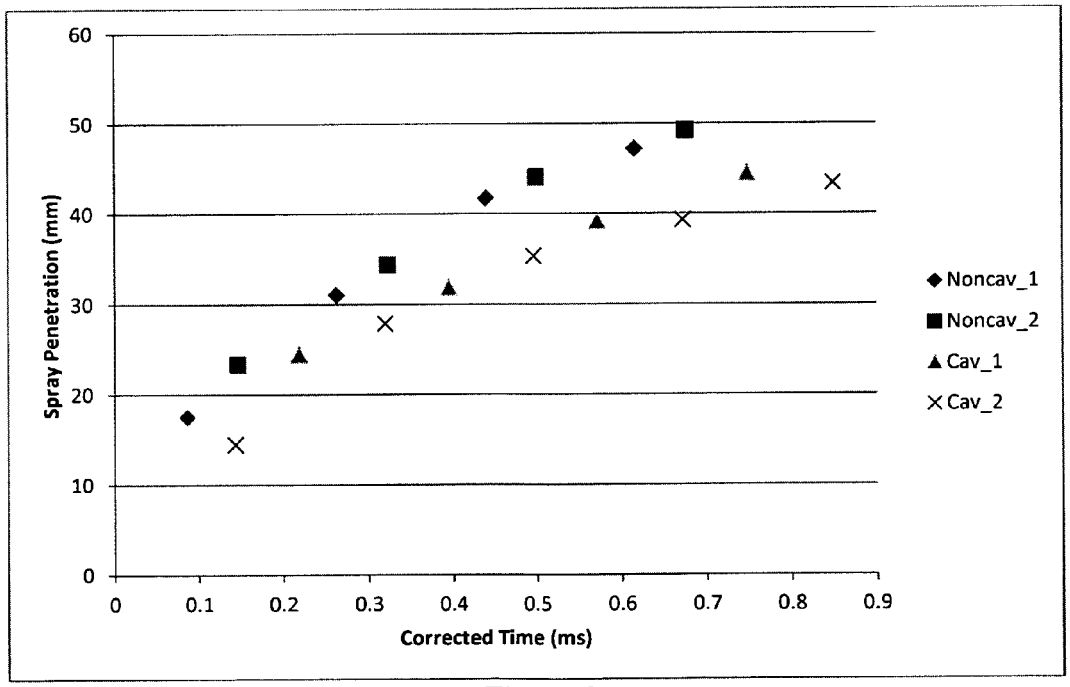
FIG. 8 is a graph showing the test results of the fuel penetration length verses time for a conventional prior art nozzle and the supercavitating nozzle of the present invention.

The next set of experiments that was performed occurred at a constant ambient pressure of 791 kPa, the same data reduction method described above was employed to determine the C-value. FIG. 8 shows the penetration data vs. time for all of the cases (both cavitating and non-cavitating) at 57° C. and 791 kPa. As shown in FIG. 8, the cavitating nozzle design provides a lower penetration length compared to the conventional non-cavitating nozzle design. This type of data analysis was repeated for all of the data and provided similar and consistent results. The results clearly show that the disclosed supercavitating nozzle geometry will reduce fuel penetration length and increase atomization.

Table 2 displays the calculated C-values for both cavitating and non-cavitating nozzle designs from a constant pressure experimentation. For the cavitating cases, the C-value has the additional benefit of decreasing with increasing temperature. The increased fuel temperature increases the vapor pressure, and thus reduces the cavitation index and promotes a higher degree of cavitation. The higher degree of cavitation leads to smaller droplets which, in turn penetrate less into the ambient gas. In fact, at the highest temperature tested, the penetration of the cavitating spray is 18.1% less than the non-cavitating spray. This benefit will further improve at the higher operating temperatures present in an actual Otto-cycle or diesel-cycle engine.

TABLE 2

C-values for cavitating and non-cavitating sprays for various temperatures at a pressure of 791 kPa

| | C-values $mm(ms)^{-1/2}$ | | | | | |
|---|---|---|---|---|---|---|
| | Cavitating | | | Non-Cavitating | | |
| T | test1 | test2 | average | test1 | test2 | average |
| 27° C. | 56.2 | 54.3 | 55.3 | 57.0 | 56.0 | 56.5 |
| 47° C. | 51.8 | 51.4 | 51.6 | 61.5 | 60.8 | 61.2 |
| 57° C. | 48.2 | 51.6 | 49.9 | 60.6 | 61.2 | 60.9 |

Our multiple experiments have demonstrated that the supercavitating injection nozzle geometry will substantially improve atomization and reduce the spray penetration length by comparing the performance of a supercavitating spray and a conventional spray at multiple temperatures and pressures. The conventional and supercavitating sprays followed the established trend of a decrease in spray penetration with increasing temperature, the decrease in the conventional spray length over the temperature range tested was 6.9%, while for our supercavitiating spray the reduction in spray length (over the same temperature range) was 13.6%, making the benefits of the supercavitating spray to reduce spray penetration length even better at the higher spray temperatures characteristic of actual engine operations. This is believed to be due to the decreasing cavitation index associated with the increase in temperature. Therefore, at diesel injection conditions, which are significantly higher temperature and pressure, the benefits of super cavitation are expected to be amplified further.

It was also shown, for the constant pressure experiments, that the penetration length of a conventional spray increases with increasing temperature whereas the spray penetration length of the supercavitating spray decreases with increasing temperature. As already stated, at the experimental case of 57° C., 791 kPa, the cavitating spray has a penetration that is 18.1% lower than a conventional spray. This dramatic improvement should continue to increase as temperatures increase towards actual combustion temperatures. The results have shown that the spray penetration for the supercavitating injector operating in situ will be at least 18% less than a conventional spray, thus enabling high pressure, common rail diesel injection.

The present invention, however, takes advantage of different flow morphologies in supercavitating flows in microchannels to reduce the characteristic size of the liquid entering the combustion cylinder. The reduction in characteristic size yields smaller droplet sizes, shorter droplet lifetimes, and therefore, a reduction in penetration length. The reduction in penetration length enables high pressure, advanced diesel injection in small engines. The improved atomization (smaller droplets) allows for better mixing with combustion air and shorter combustion durations, leading to higher operating speeds of conventional sized diesel engines.

While the illustrated currently preferred embodiment uses a stepped nozzle (sudden expansion) to create the supercavitating flow morphologies as shown in FIG. 5, it will now be apparent to those skilled in the art that supercavitation can be achieved in a number of different ways such as flow over a bluff body, sharp angled flow turns, etc.

In summary, this invention is the utilization of supercavitation in a diesel injector to reduce penetration lengths, improve atomization, and reduce combustion times. In the preferred embodiment, a stepped nozzle will accomplish the supercavitating flow regimes necessary. This nozzle configuration is also easy to fabricate.

While the preferred embodiments of the invention have been illustrated and described, it should be understood that, after reading this disclosure, variations to this embodiment will be apparent to one skilled in the art without departing from the principles of the invention described herein.

What is claimed is:

1. In a conventional fuel injector having a needle moveable along an axis, and a tapered wall nozzle injector tip with a cup-shaped portion at an end of the tapered wall downstream of the needle to define a sac volume therebetween and configured to extend into a combustion chamber of an engine, the improvement comprising the nozzle tip having in the tapered wall at least one fuel injection port directed at an angle to the axis and configured with an inlet section of constant diameter adjacent the sac volume and an outlet section of substantially greater length than the inlet section, the outlet section having a constant diameter larger than that of the inlet section through which exclusively fuel flows and sized to produce within the at least one inlet port supercavitating flow of fuel injected into the engine combustion chamber.

2. The fuel injector of claim 1, wherein the at least one port is devoid of a continuous smooth transition between the inlet section and the outlet section.

3. The fuel injector of claim 1, wherein the inlet section is sized and configured to substantially reduce static pressure of fuel being injected through the nozzle injector tip into the engine combustion chamber.

4. The fuel injector of claim 3, wherein a stepped region configured as a wall is provided between the inlet section and the outlet section.

5. The fuel injector of claim 1, wherein the diameter of the outlet section is about 12 times the diameter of the inlet section.

6. The fuel injector of claim 1, wherein the outlet section has a length, as viewed in a fuel flow direction, of about 3 mm.

7. The fuel injector of claim 1, wherein the injector is a piezo-electric, or solenoid operated device.

8. The fuel injector of claim 1, wherein the inlet section has a diameter of about 80 μm.

9. The fuel injector of claim 8, wherein the outlet section has a length of at least 3 mm as viewed in a fuel flow direction through the port.

10. In as method of reducing spray penetration length and improving fuel atomization in a conventional fuel injector having a needle moveable along an axis and a tapered nozzle injector tip with at least one port downstream of the needle to define a sac volume therebetween and configured to extend into an engine combustion chamber, the injector tip having at least one port directed at an angle to the axis for communicating with the engine combustion chamber, the improvement comprising flowing exclusively fuel through the at least one port sized and configured to have an inlet section of constant diameter adjacent the sac volume, and an outlet section of substantially greater length than the inlet section and having a constant diameter larger than that of the inlet section to produce within the at least one inlet port supercavitating flow in a region of the at least one port where fuel is injected into the engine combustion chamber.

* * * * *